US006698149B1

(12) United States Patent
Ruchgy

(10) Patent No.: US 6,698,149 B1
(45) Date of Patent: Mar. 2, 2004

(54) COMPOSITE LAMINATED BUILDING MATERIAL, AND METHODS OF MAKING AND USING SAME

(75) Inventor: Joseph L. Ruchgy, Marlette, MI (US)

(73) Assignee: Paragon Building Systems, Inc., Marlette, MI (US)

( * ) Notice: Subject to any disclaimer, the term of this patent is extended or adjusted under 35 U.S.C. 154(b) by 0 days.

(21) Appl. No.: 10/335,408

(22) Filed: Dec. 31, 2002

Related U.S. Application Data

(60) Provisional application No. 60/352,898, filed on Jan. 29, 2002.

(51) Int. Cl.[7] ..... E04C 1/00

(52) U.S. Cl. ..... 52/309.4; 52/309.11; 52/309.13; 52/385; 52/389; 52/785

(58) Field of Search ..... 52/63, 90, 309.4, 52/309.11, 309.13, 385, 389, 785

(56) References Cited

U.S. PATENT DOCUMENTS 3,753,323 A * 8/1973 Nesbitt ..... 52/169.12
3,832,813 A * 9/1974 Hindman ..... 52/169.12
3,984,957 A * 10/1976 Piazza ..... 52/309.9
4,078,348 A * 3/1978 Rothman ..... 52/309.7
4,186,536 A * 2/1980 Piazza ..... 52/309.12
4,229,497 A * 10/1980 Piazza ..... 428/71
4,357,384 A * 11/1982 Jasperson ..... 428/215
4,557,970 A * 12/1985 Holtrop et al. ..... 428/316.6
4,657,798 A * 4/1987 Guilhem ..... 428/71
4,680,904 A * 7/1987 Stoecker ..... 52/169.12
4,767,656 A * 8/1988 Chee et al. ..... 428/116
4,774,794 A * 10/1988 Grieb ..... 52/309.7
4,810,569 A * 3/1989 Lehnert et al. ..... 442/386
4,843,793 A * 7/1989 Ayers ..... 52/169.12
4,973,506 A * 11/1990 Bauer et al. ..... 428/73
5,060,291 A * 10/1991 Albertelli ..... 428/306.6
5,483,778 A * 1/1996 Scrivener ..... 52/579
5,791,109 A * 8/1998 Lehnert et al. ..... 52/309.17
6,044,604 A * 4/2000 Clayton et al. ..... 52/309.9
6,205,720 B1 * 3/2001 Wolfrum ..... 52/169.12
6,220,388 B1 * 4/2001 Sanborn ..... 181/290
6,235,367 B1 * 5/2001 Holmes et al. ..... 428/45
6,443,257 B1 * 9/2002 Wiker et al. ..... 181/290
2002/0155282 A1 * 10/2002 Randall et al. ..... 428/341

* cited by examiner

*Primary Examiner*—Cathy Lam
(74) *Attorney, Agent, or Firm*—Carrier, Blackman & Associates, P.C.; William D. Blackman; Joseph P. Carrier

(57) ABSTRACT

A decorative laminated building panel, usable for placement on an exterior surface of a building to improve the appearance thereof. The panel includes a foam core, a thin fabric mat attached to at least one surface of the foam core, and a durable material attached to the fabric mat with a binding agent. The durable material is intended to be used on an outward-facing surface of the panel, and may be selected from materials including stone, tile, and brick. Optionally, the panel may include a final finish covering the exposed exterior surface thereof, to give a more pleasing appearance. The panel is intended for a non load-bearing application, and the rear surface of the panel is preferred to be substantially cement-free, that is, free of Portland-type cement. Among other uses, panels according to the invention are suitable for use as exterior skirting material on manufactured homes.

13 Claims, 3 Drawing Sheets

COMPOSITE LAMINATED BUILDING MATERIAL, AND METHODS OF MAKING AND USING SAME

This application claims the benefit of Provisional Application Ser. No. 60/352,898 filed Jan. 29, 2002.

BACKGROUND OF THE INVENTION

1. Field of the invention

The present invention relates to a decorative composite laminated building material, suitable for decorative placement on an exterior surface of a building, and to methods of making and using such material. More particularly, the present invention relates to a non load-bearing composite laminated material, including an insulating foam core, and also including a durable material such as tile, brick or stone on an outwardly facing surface thereof.

2. Description of the Background Art

A number of different types of laminated building materials are known. Examples of some of the known laminated building materials are described in U.S. Pat. No. 4,078,348 to Rothman, U.S. Pat. No. 4,774,794 to Grieb, U.S. Pat. No. 4,973,506 to Bauer et al., U.S. Pat. No. 5,483,778 to Scrivener, and U.S. Pat. No. 6,235,367 to Holmes et al.

Grieb, U.S. Pat. 4,774,794 discloses a laminated building block, made up of a foam core with a combined fiberglass and cementitious coating surrounding all sides of the core. The building blocks disclosed by Grieb are self-supporting, and may be used in a load-bearing application, without a separate frame, to build structures such as homes and commercial buildings.

Bauer et al., U.S. Pat. No. 4,973,506 discloses a decorative composite plate for facing exterior building surfaces. The plate of Bauer et al. has a honeycomb core structure disposed between two cover layers. An outer cover layer carries a decorative panel, which may consist of stone, and the inner cover layer carries a protective plate.

A number of different types of skirting material are known for use with mobile homes. Examples of the known skirting materials include those disclosed in U.S. Pat. No. 3,753,323 to Nesbitt, U.S. Pat. No. 3,832,813 to Hindman, U.S. Pat. No. 4,680,904 to Stoecker, U.S. Pat. No. 4,843,793 to Ayers, and U.S. Pat. No. 6,205,720 to Wolfrum.

Although the known laminated building materials are useful for their intended purposes, a need still exists in the art for building materials that are useful for decorative exterior placement on buildings. In particular, there is a need for a relatively lightweight and low cost decorative building material that is easy to install, and that includes a durable material such as stone, tile or brick on an exterior surface thereof, for improving the appearance of buildings.

SUMMARY OF THE INVENTION

The present invention provides a decorative, composite laminated building panel which is suitable for placement on an exterior surface of a building, to improve the appearance thereof.

A laminated panel in accordance with the present invention, generally, includes a foam core, a relatively thin fabric mat attached to at least one surface of the foam core, and a durable material attached to the fabric mat with a binding agent.

Preferred durable materials for use in the panels of the present invention include stone, tile, and brick.

Optionally, the panel may also include a protective outer finish, covering the exposed exterior surface thereof, to give a more pleasing appearance.

A panel according to the invention is intended for a non load-bearing interior or exterior application, and the rear surface of the panel is preferred to be substantially cement-free, that is, substantially free of Portland-type cement. Among other uses, panels according to the invention are suitable for use as skirting material on manufactured homes.

Accordingly, it is an object of the present invention to provide a decorative laminated panel which is suitable for placement on a building surface, the panel including a durable and decorative material on a visible outward-facing surface thereof.

It is another object of the invention to provide a decorative laminated panel having insulating properties.

It is yet another object of the invention to provide a decorative laminated panel which is intended for substantially non load-bearing use.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
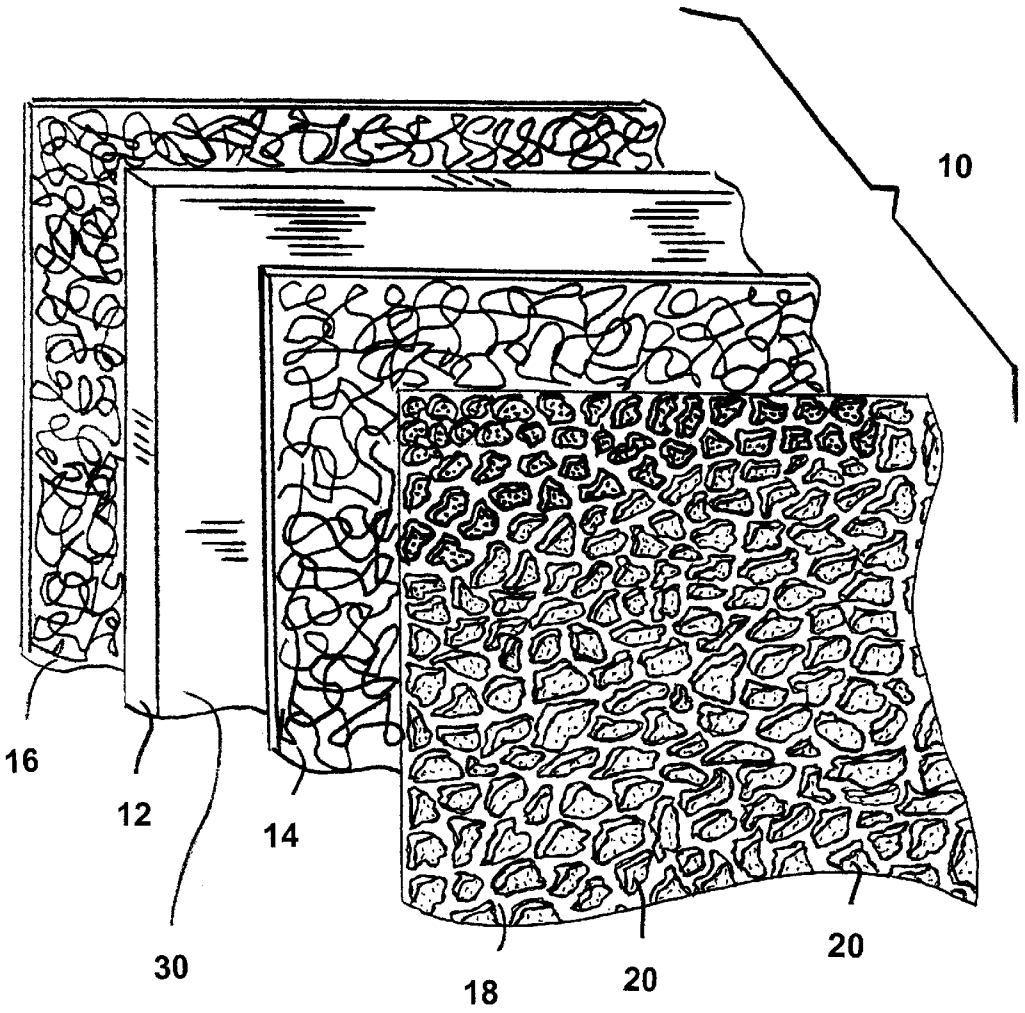
FIG. 1 is an exploded perspective view, partially cut away, of a laminated panel in accordance with a first embodiment of the present invention.
Figure 2:
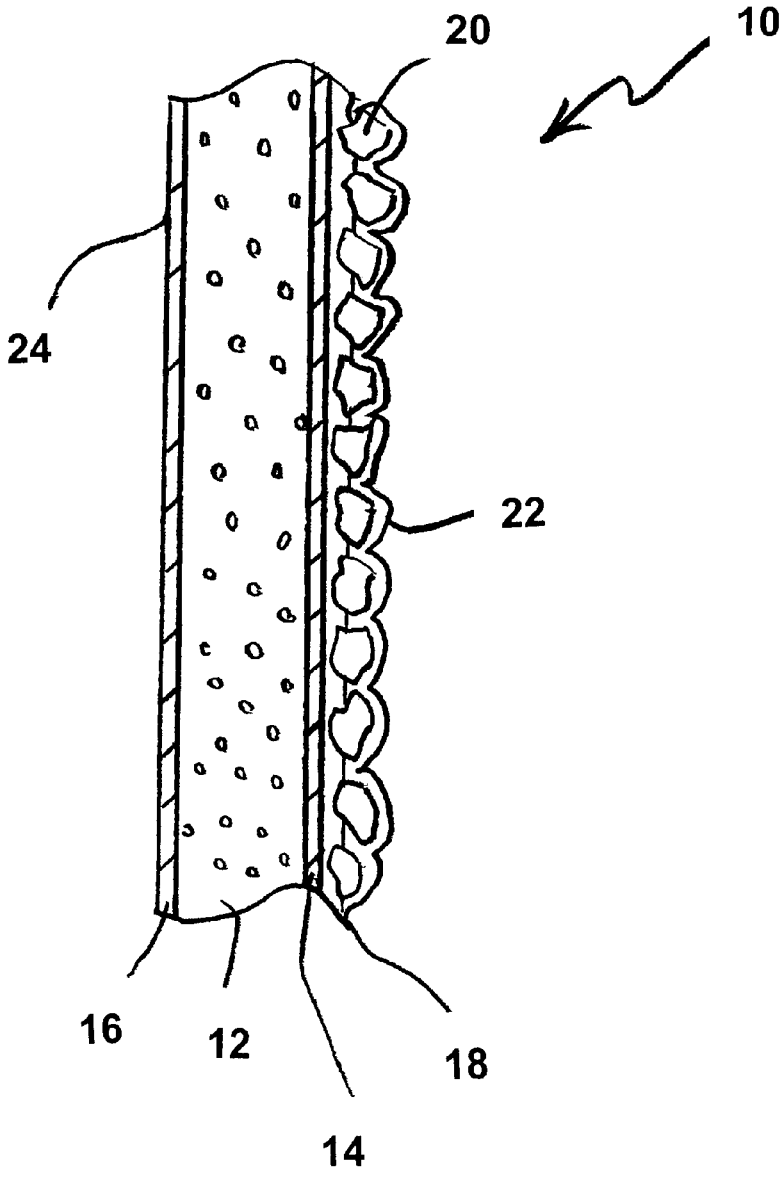
FIG. 2 is a cross-sectional view of the laminated panel of FIG. 1.

Referring now to FIGS. 1–2 of the drawings, a decorative laminated building panel, in accordance with a first embodiment of the invention, is shown generally at 10. The panel 10 is intended for placement on an interior or exterior surface of a building, to improve the appearance thereof.

The panel 10 is intended to be used in a passive non load-bearing application, and is not intended to support any substantial weight thereon. Since it is not a load-bearing panel, the panel 10 can be made lighter and less expensively than a load-bearing panel, and as a result, can be competitively priced. Further, the rear surface 24 (FIG. 2) of the panel 10 according to the present invention is preferred to be substantially cement-free.

The term "cement-free", as used herein, is used narrowly and is intended to mean free of Portland-type cement.

It should be noted that, while the panel 10 is not intended to support any significant load, the outward-facing surface of the panel is quite durable. As a result, the panel 10 is suitable for long-term use on an exterior surface of a building. Accordingly, all of the materials used for the panel 10 should be selected to be weather-resistant over time, and to be resistant to degradation by sunlight. The panel 10 is usable to form skirting on a premanufactured home or other application. The panel 10 may also be used on a conventional home or commercial building, to decoratively cover exposed cement on a building foundation.

As best seen in FIG. 1, the laminated panel 10, generally, includes a foam core 12, a thin fabric mat 14 attached to at least one surface of the foam core, and a display layer 18, made up of durable material attached to the fabric mat with a binding agent, for placement facing outwardly, when the panel is attached to a wall (not shown).

The foam core 12 may be commercially available foam material such as foamed polystyrene, polyethylene, or other similar material. The type of material used for the foam core 12 is often referred to as composite board in the building trade. The foam core 12 may be any thickness from ¼ inch to 4 inches, however, the preferred thickness of the foam core for most residential uses is between ⅜ inch and 1 inch.

The fabric mats 14, 16 used to cover the side surfaces of the foam core 12 are preferably nonwoven fabric mats, however, woven fabric mats may also be used. Fiberglass is a preferred material for the fabric mats 14, 16. Other strong, durable material such as nylon, polyester or Kevlar® fiber may be used to form the fabric mats 14, 16 (Kevlar is a registered trademark of E. I. DuPont De Nemours and Company).

The fabric mat 14 is attached to the foam core 12 using a suitable adhesive resin, which may be a thermosetting polyester, polyurethane, styrene, a mixture of the above, or other known material suitable for the task. The resin should include a catalyst to promote polymerization thereof. Preferred resins are industrial resins used in the manufacture of cast fiberglass articles.

Preferably, the panel 10 includes separate fabric mats 14, 16 on each side of the foam core 12, as shown. The rear side of the panel 10 is preferred to be substantially cement-free.

As noted, the display layer 18 includes a plurality of durable particles attached to the fabric layer. The durable particles should include some particles of at least one material which includes stone, tile, and brick. In the embodiment of FIGS. 1–2, the display layer 18 includes a multiplicity of particles 20 of natural stone.

Preferred durable materials for use in forming the display layer 18, in the panels of the present invention, may be selected from a list which includes crushed stone, pea stone, seashells, fieldstone, tile, and brick. The above list is not intended to be restrictive or all-inclusive, but rather, is provided to give examples of materials which may be used. Any given panel, however, and any given installation of the panels according to the invention, will preferably use only one material, which may be selected from the above list.

The materials of the display layer 18 are attached to the fabric mat 14 using the adhesive resin discussed above, or using another suitable binding agent which is tolerant to prolonged outdoor exposure.

Optionally, the display layer 18 may include a protective final finish layer 22 (FIG. 2) covering the exposed exterior surface thereof, to give a more pleasing appearance. Where used, this final finish Layer 22 may be formed from the same resin used to affix the display layer 18 to the fiberglass mat 14. Alternatively, the final finish layer 22 may be a different type of clear sealer, which may include an acrylic, epoxy, polyurethane, powder coat, or other suitable material. As is well known in thc art, powder coatings are coating materials that are applied as a dry powder, and are cured by heat or radiation to create a smooth, durable finish.

A panel 10 according to the invention is intended for a non load-bearing interior or exterior application. As a result, the rear surface 24 of the panel is able to remain substantially cement-free, as noted. This allows the panel 10 to be made lighter, and using less materials, than would be possible if the panel were intended to bear a load, thereby allowing the panel to be made economically and priced competitively.

Method of Making the Panel

In forming the panel 10 according to the invention, an adhesive resin, which may be a thermosetting polyester, polyurethane, styrene or other known material suitable for the task is applied to a first surface 30 of the foam core 12. Preferred resins are industrial resins used as fiberglass resins. Then, a first fabric mat 14 is applied to the adhesive-coated surface 30. This may be a woven or a non-woven mat, although non-woven is preferred.

After the first fabric mat 14 is applied to the foam core 12, a roller (not shown) is rolled over the surface thereof to remove air bubbles out from the area beneath the mat. Heat may be then applied to start the polymerization of the resin. Optionally, a second fabric mat 16 may be applied to the rear surface of the foam core, in similar fashion.

Then, a second coat of the adhesive resin is applied to cover the first fabric mat 14, and the materials for the display layer 18 are placed into the uncured resin. Where crushed stone is used for the display layer, a roller may be used again at this stage to distribute and spread out the particles 20 making up the display layer 18. The resin is then cured to fix the position of the particles 20 therein. Optionally, if desired, a final finish layer 22 may be applied over the display layer. Where used, the final finish layer 22 may provide a glossy finish and a 'wet' look to the display layer 18.

Second Embodiment

Figure 3:
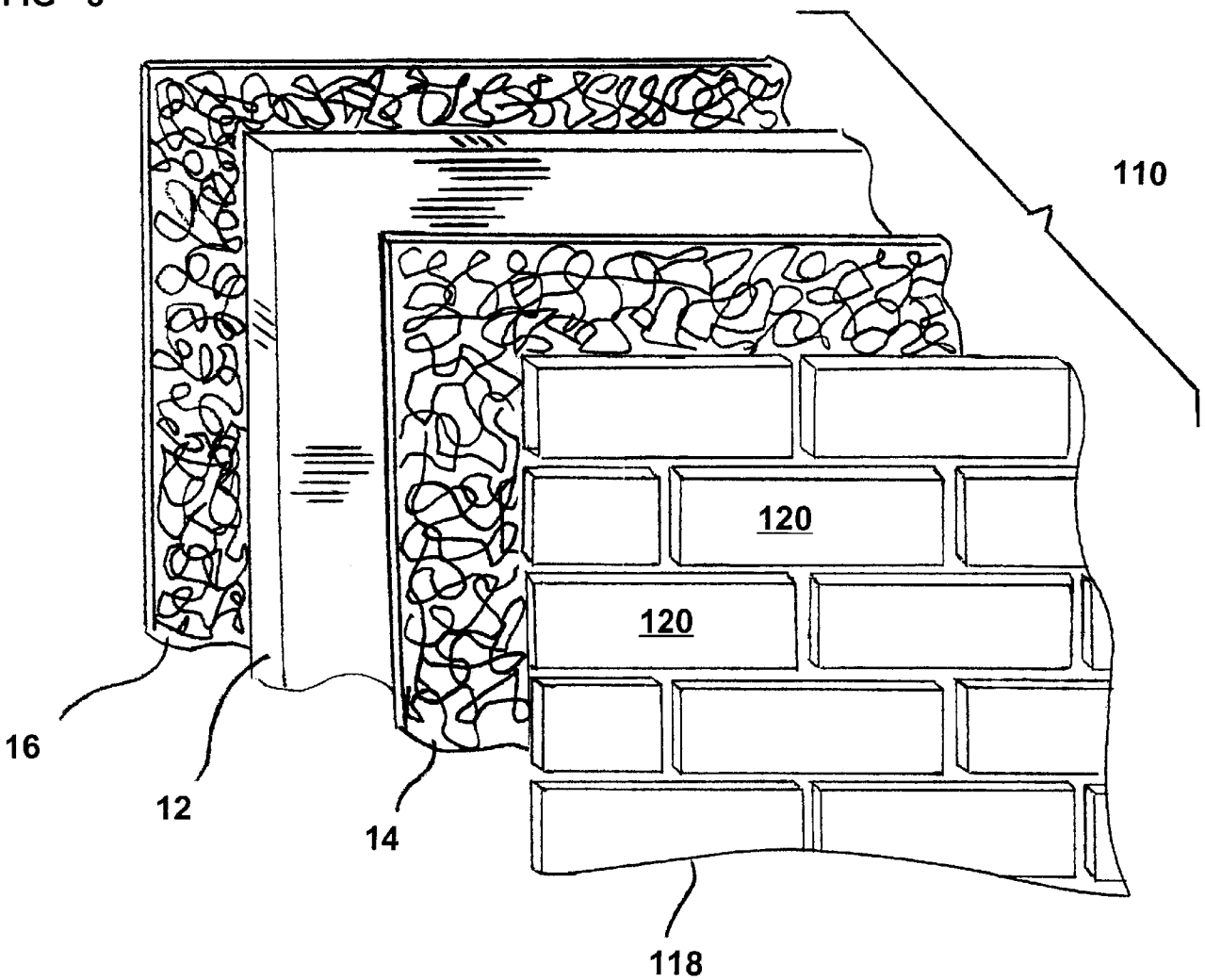
FIG. 3 is an exploded perspective view, partially cut away, of a laminated panel in accordance with a second embodiment of the present invention.

Referring now to FIG. 3, a modified embodiment of a decorative insulating panel according to the invention is shown at 110. In this modified composite panel 110, the laminated panel 110, generally, includes a foam core 12, a thin fabric mat 14 attached to at least one surface of the foam core, and a display layer 118, made up of durable material attached to the fabric mat with a binding agent, for placement facing outwardly. Preferably, the panel 110 includes separate fabric mats 14, 16 on each side of the foam core 12, as shown.

In the embodiment of FIG. 3, the display layer 118 includes a plurality of brick veneer pieces 120, arranged in a manner so as to present the appearance of a brick wall.

Installing the Panels on a Building Surface

The panels 10 according to the invention may be installed on interior or exterior walls, as desired. Some insulating effect is provided by the use of the panel 10. The panels can be installed using a compatible adhesive, mechanical fasteners such as screws, or a combination of both. Panels 10 according to the invention may be applied to concrete, to wood or steel framing, or to exterior sheathing. The panels 10 may be trimmed to fit a particular application using a circular saw with a diamond-tipped blade.

Installation of the panels 10 as skirting around a manufactured home may be done using conventional top trim and bottom channel materials, which are commercially available. Due to the inherent rigidity of the panels 10, the vertical joints in a skirting application are held by friction between the panels, and panels up to 36 inches may be used without requiring any additional framing.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the written description are intended to be within the scope and spirit of the present invention.

Having, thus, described the invention, what is claimed is:

1. A decorative, laminated non load-bearing panel for attaching to a building surface, said panel comprising:

a foam core;

a fabric layer attached to at least one surface of the foam core; and a plurality of durable particles attached to the fabric layer, wherein said durable particles comprise at least one material selected from the group consisting of stone, tile, and brick;

said panel including a rear surface which is substantially cement free.

2. The panel of claim 1, wherein the fabric layer comprises fiberglass.

3. The panel of claim 1, wherein each of the front and rear surfaces of the foam core has a fabric layer thereon.

4. The panel of claim 3, further comprising a transparent protective coating applied to the durable particles.

5. A decorative, laminated non load-bearing panel for attaching to a building surface, said panel comprising:

a foam core;

a fabric layer attached to at least one surface of the foam core; and a puitrality of durable particles attached to the fabric layer, wherein said durable particles comprise at least one material selected from the group consisting of stone, tile, and brick; and a transparent protective coating applied to the durable particles.

6. A decorative non load-bearing panel for attaching to a building surface, said panel comprising:

a foam core, a thin fiberglass mat attached to at least one surface of the foam core; and a plurality of stone particles attached to the fiberglass mat, wherein said durable particles conprise at least one material selected from the group consisting of stone, tile, and brick;

wherein the panel includes a rear surface which is substantially cemtent-free.

7. The panel of claim 6, further comprising a protective coating applied to the durable particles.

8. The panel of claim 6, wherein the durable material comprises stone.

9. The panel of claim 6, wherein each of the front and rear surfaces of the foam core has a layer of fiberglass fabric thereon.

10. A decorative laminated non load-bearig panel for attaching to a building surface, said panel comprising:

a foam core having a front surface and a rear surface;

a fabric layer attached to each of the front and rear surfaces of the foam core;

a plurality of durable particles attached to the fabric layer at the front of the foam core, wherein said durable particles comprise at least one material selected from the group consisting of stone, tile, and brick; and a transparent protective coating applied to the durable particles, said protective coating selected from the group consisting of acrylics, epoxies, curable resins, polyurethanes, and powder coatings;

wherein the panel has a rear surface which is substantially free of Portland cement.

11. The panel of claim 10, wherein the material of each of the fabric layers comprises fiberglass.

12. The panel of claim 10, wherein the durable material comprises stone.

13. A method of making a decorative laminated panel, comprising the steps of:

applying an adhesive material to a surface of a foam panel;

attaching a fabric mat to the panel surface;

applying an adhesive material over the fabric mat; running a roller over the fabric mat to remove air bubbles; and applying a protective coating to the durable particles on the panel.

affixing a plurality or durable particles to the fabric mat, wherein said durable particles comprise at least one material selected from the group consisting of stone, file, and brick.

* * * * *